US005651552A

United States Patent [19]

Whelchel

[11] Patent Number: 5,651,552

[45] Date of Patent: Jul. 29, 1997

[54] NET ATTACHMENT AND TENSIONING SYSTEM

[76] Inventor: Sean P. Whelchel, 1135 Catalina Ave., Seal Beach, Calif. 90740

[21] Appl. No.: 629,406

[22] Filed: Apr. 8, 1996

[51] Int. Cl.[6] ..... A63B 61/04

[52] U.S. Cl. ..... 473/494

[58] Field of Search ..... 273/411, 29 B, 273/29 BB, 29 BC

[56] References Cited

U.S. PATENT DOCUMENTS

| | | | |
|---|---|---|---|
| D. 308,473 | 6/1990 | Pohrer . | |
| 1,646,467 | 10/1927 | Walton . | |
| 2,159,633 | 5/1939 | Petersen . | |
| 2,428,075 | 9/1947 | Hare . | |
| 2,638,346 | 5/1953 | Stapleton . | |
| 2,799,240 | 7/1957 | Andrews . | |
| 3,680,526 | 8/1972 | Buffington, Jr. . | |
| 3,940,139 | 2/1976 | Barnes . | |
| 3,961,789 | 6/1976 | Tabacheck . | |
| 4,153,247 | 5/1979 | Burns | 273/29 BC |
| 4,253,671 | 3/1981 | Pace | 273/411 |
| 4,415,163 | 11/1983 | Schoenig | 273/411 |
| 4,717,157 | 1/1988 | Smith . | |
| 4,791,878 | 12/1988 | Lewis . | |
| 4,844,477 | 7/1989 | Pardi | 273/411 X |
| 4,968,042 | 11/1990 | Stewart | 273/411 |
| 4,968,043 | 11/1990 | Allbright | 273/411 |
| 4,973,059 | 11/1990 | Stewart | 273/411 |
| 5,062,646 | 11/1991 | Crist | 273/411 |
| 5,096,022 | 3/1992 | Bowers . | |
| 5,215,310 | 6/1993 | Allbright | 273/411 |

OTHER PUBLICATIONS

Ultimate Systems Limited brochure, 1995.
Volleyball One Sales Company 1994–1995 catalog.
Mac's Networks advertisement (photocopy).
Park & Sun USA's advertisements (photocopies).
Home Court advertisement (photocopy).
Centerline Court advertisement (photocopy).
Outaboundz USA advertisement (photocopy).
Centerline Court brochures.
West Coast Netting, Inc. brochures.

*Primary Examiner*—William H. Grieb
*Attorney, Agent, or Firm*—Lyon & Lyon

[57] ABSTRACT

A volleyball net is disclosed that has a net assembly having a right side, a left side, and a netting therebetween. The net has a pair of tensioning bars attached to each side, and each tensioning bar has a plurality of rotational members for receiving the line. The line is threaded proximate the rotational members of the tensioning bars, and attached to a pair of posts using a plurality of couplings. The line is locked into place using a line lock proximate one of the couplings. The improved volleyball net simplifies installation and removal. Furthermore, the improved net provides consistent tension on all net surfaces, and enables the user to place the net at the proper height.

12 Claims, 9 Drawing Sheets

NET ATTACHMENT AND TENSIONING SYSTEM

FIELD OF THE INVENTION

This application relates to an attachment and tensioning system used in the suspension of a game net, particularly for use with volleyball nets.

BACKGROUND

Volleyball is one of the world's fastest growing sports. It is played both indoors and outdoors and, at all levels, from recreational to professional. One of the many reasons for its popularity is the relative simplicity of the equipment involved. All that is needed is a net, a means to support the net, and a volleyball. The basic equipment is similar regardless of the level of competition.

Generally, the net is attached between two posts. The attachment and tensioning of the net between the two posts is a crucial aspect of the game that presents a number of unique challenges. In volleyball, the ball may be played off of the net, so it is important that the net have substantially consistent tension at all points, and to retain this consistent tension throughout a match. The net needs to be level and set at the proper height. Also, it is important for the net to be placed substantially equidistant from the posts so as to prevent player injury and align properly with the court boundaries, among other things. It is preferred that the net assembly have simple, easy-to-use hardware to allow quick installation.

In the past, the act of assembling the net has been a frustrating and time-consuming task. Generally, posts are used to provide the vertical support for volleyball nets. These posts generally have a pair of eyebolts mounted at approximately the same height as the top and bottom of the net. Correspondingly, nets have been constructed with an eyelet in each corner to allow for attachment of a line. To mount the net, individual lines mounted to each corner of the net are attached independently to each of the four eyebolts on the posts (two posts with two eyebolts each). Each of the four independent lines then need to be adjusted, one at a time, to ensure that the net is level and at the proper height, has uniform tension, and is mounted squarely equidistant from the posts. Devices have been used to simplify this task, but still rely on independent tensioning of the lines. Many of these devices are attached to the posts with some sort of winch to apply tension and remove slack in the net.

Additionally, the eyebolts are often spaced at differing distances apart, thereby making it difficult to achieve uniform vertical and horizontal tension. This can result in an inconsistent "bounce" off of the net and even lead to parts of the net sagging.

The above noted problems are especially onerous for recreational players where the net is frequently installed and taken down. For example, beach volleyball courts often have permanent, or semi-permanent, posts erected in the sand, and volleyball players bring their own net and equipment. Beach volleyball posts are typically two to six inches in diameter, mounted upright in the sand, and each having a pair of vertically spaced eyebolts (or similar attachment devices). Additionally, the top of the net is generally set at a height that makes it difficult to make the multiple independent adjustments, especially for shorter players.

Attempts have been made to remedy the shortcomings discussed above. Exemplary devices are described in U.S. Patents issued to Pardi (U.S. Pat. No. 4,844,477), Burns (U.S. Pat. No. 4,153,247) and Stewart (U.S. Pat. Nos. 4,973,059 and 4,968,042). Pardi ('477) illustrates the problems of these devices. It describes a system for tensioning a net having generally two cables, two ratchet flat straps, and four ties, all of which need to be independently adjusted to install the net at the proper height, with the proper tension, and centered between the posts. Burns ('247) describes a complicated net assembly having specialized parts that would be difficult to transport and install. Stewart ('042) describes a simpler net assembly, but still has shortcomings. For example, it relies on the use of a winch to be attached to the post, requires the use of a separate cable length adjustment means (such as a chain), and has no direct means for providing consistent tension across the entire surface area of the net. Stewart ('059) suffers similar shortcomings. It requires the use of multiple cables on each end (winch cable, upper cable and lower cable) and a winch attached to a post or slidable mounting hardware, and has no direct means for providing consistent tension across the entire surface area of the net.

SUMMARY OF THE INVENTION

The present invention provides an improved net attachment and tensioning system by making the installation and removal of the net faster and easier. The improved net incorporates part of the tensioning system within the net itself. A preferred embodiment combines a single line, pulleys, and a line lock device, together with a novel design of the net assembly, to make installation and removal simple and quick, yet allow proper placement and tensioning of the net. The net assembly has a tensioning bar located proximate each end of the net to provide consistent tension on all net surfaces. A second, similar embodiment uses one line for each end of the net and a similar design of the net assembly and tensioning bar to accomplish many of the same performance characteristics and effect a reduction in installation time.

Accordingly, it is an object of the present invention to provide an improved net attachment and tensioning system.

BRIEF DESCRIPTION OF DRAWINGS

These and other objects of the present invention will become better understood through a consideration of the following description taken in conjunction with the drawings in which.

DETAILED DESCRIPTION

Figure 1:
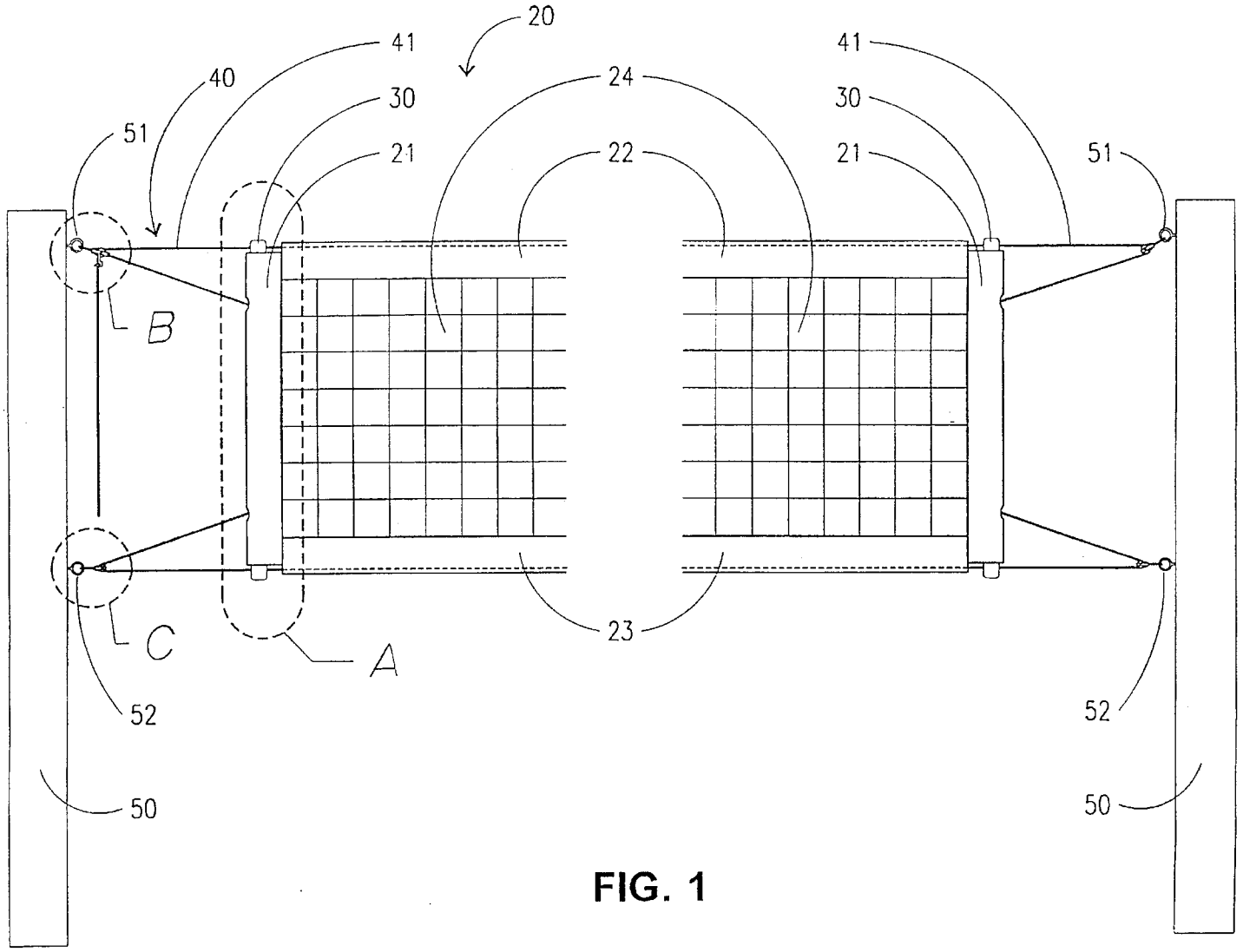
FIG. 1 is a front view of both ends of a preferred volleyball net, showing two posts, a net assembly, a single line assembly and mounting hardware.

Turning now to the drawings, FIG. 1 depicts a preferred net attachment and tensioning system 10. The system 10 comprises a net assembly 20, a pair of posts 50, a pair of tensioning bars 30, and a line assembly 40.

The posts 50 are well known in the art and can be either permanently erected or removable, depending on the location. Many times the posts are erected on sand volleyball courts in parks and at the beach. Generally these posts have a top eyebolt 51 and a bottom eyebolt 52, or other means known in the art for attaching a net.

The preferred net assembly comprises a pair of side sleeves 21, a top sleeve 22, a bottom sleeve 23 and a netting 24, which comprises the majority of the surface area of the net assembly 20. The materials used in the netting 24 and the sleeves 21, 22 and 23 are known in the art.

Figure 3:
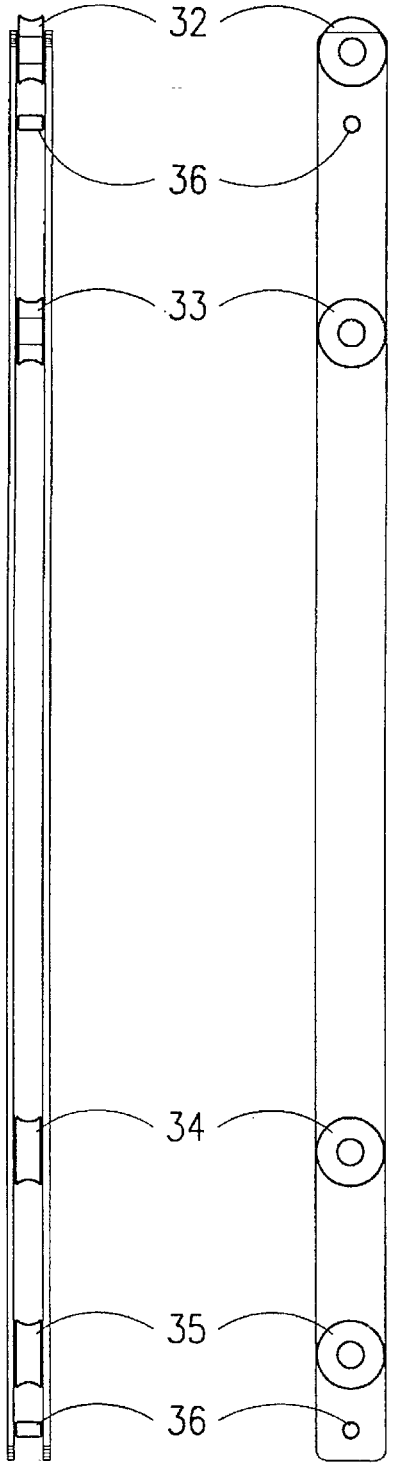
FIG. 3 is an enlarged view of the embodiment shown in FIG. 1, showing front and side views of the tensioning bar.
Figure 2:
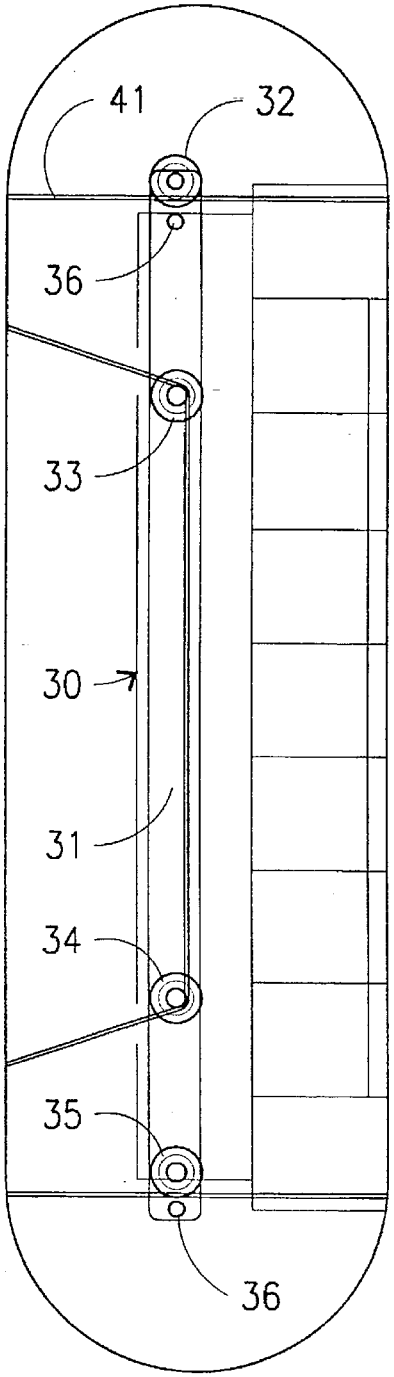
FIG. 2 is an enlarged view of the embodiment shown in FIG. 1, at A, illustrating the interrelationship of a side sleeve, tensioning bar, and line.

FIGS. 2 and 3 depict a tensioning bar 30, which is vertically and fixedly attached to a side sleeve 21 of the net 20. Preferably, each tensioning bar 30 is constructed of two flat rectangular members 31 that are held parallel to each other and spaced apart by a pair of rivets 36 and a plurality of sheaves 32–35. Each rectangular member 31 is attached using two rivets 36 placed near the ends of the bar 30. When mounted to the net 20, the rivets are located near each corner of the net 20. The left side of FIG. 3 views the tensioning bar 30 from the side nearest to the pole 50. This end is open to allow direct access to the sheaves 32–35 for stringing a line 41. The tensioning bars 30 may be attached to the side sleeves 21 in various ways. One such way is to construct each side sleeve 21 in the form of a pocket, with each tensioning bar 30 inserted therein, with a pair of slits in the side sleeves 21 to allow a line 41 to be inserted.

Figure 4:
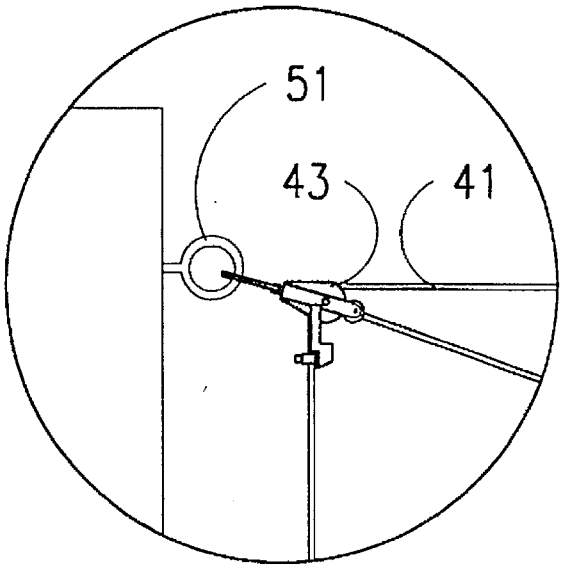
FIG. 4 is an enlarged view of the embodiment shown in FIG. 1, at B, showing a preferred cam and becket used to secure two ends of the line to a top eyebolt.
Figure 5:
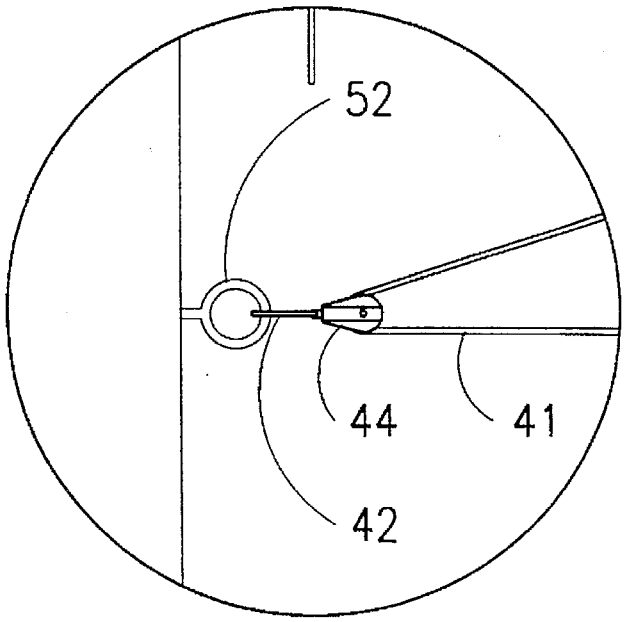
FIG. 5 is an enlarged view of the embodiment shown in FIG. 1, at C, showing the attachment of a preferred pulley, coupling and bottom eyebolt.

Referring to FIGS. 1, 4 and 5, the preferred line assembly 40 comprises a single line 41, multiple couplings 42, a cam and becket 43 and multiple pulleys 44. Preferably the single line 41 runs through each sleeve and adjacent each corner of the net 20. The line is originally fixedly anchored to the becket part of the cam and becket 43 (shown in the upper left in FIG. 1 and in detail in FIG. 4). In the preferred embodiment, as shown in FIGS. 1 and 2, the line 41 thereafter engages the second sheave 33, the third sheave 34 and returns to engage the pulley 44, shown in detail in FIG. 5. The cam and becket 43 and each of the pulleys 44 are attached to the eyebolts 51 and 52 with detachable couplings or other couplings known in the art. The line 41 then passes between the fourth sheave 35 and the rivet 36, then through a cavity in the bottom sleeve 23. After passing through the bottom sleeve 23, the line 41 travels a path similar to that described above, only this time to the right in FIG. 1. Note that the preferred tensioning bar 30 used on the right side is the same as the one used on the left. The line 41 passes between the fourth sheave 35 and the rivet 36, then engages the bottom pulley 44, the sheaves in the tensioning bar 33 and 34, and the upper pulley 44 in a similar fashion as described above, before passing through a cavity formed in the top sleeve 22. Prior to passing through the top sleeve 22, the line 41 passes between the first sheave 32 and the rivet 36. Lastly, the line passes through the cam part of the cam and becket 43.

The above-described components used for the preferred embodiment are similar to those used for marine applications, as for rigging a sailboat. The sheaves may alternatively comprise a variety of rotational members known in the art, as long as the line is able to pass over and around the rotational member without excess frictional forces. Solid posts between the rectangular bars could also be used, as long as they do not create too much friction when the line passes over the posts.

All components of the net assembly 20 may remain loosely attached when the net assembly 20 is detached from the eyebolts 51 and 52, thereby minimizing loss of components between use. Installing the preferred net can be accomplished in the following few steps, and can easily be accomplished by one person. First, each coupling 42 is attached to a corresponding eyebolt 51 and 52. The user then adjusts the slack in the net 20 so as to move it from side to side in order to center it between the posts 50. Finally, the user pulls the line 41 firmly downward (or away) from the cam and becket 43 in order to lock the net 20 into place.

The net 20 is then firmly held in place with the line 41 providing tension for the top and bottom of the net, and the tensioning bars 30 evenly spreading the tension over the entire netting 23.

If the net 20 is not centered, the user can easily adjust it in one of two ways. First, the user can simply pull on the net 20 to move it horizontally. Because there is a single line 41, the net is able to move while retaining its tension. Second, the user can release the tension by releasing the cam and becket 43. To move the net 20 to the right, the user simply releases slack from the cam and becket 43 and pulls the line 41 through the bottom sleeve 23, thereby moving the right tensioning bar 30 to the right and pulling the net 20 to the right. The user would then pull out the slack by pulling the line 41 through the cam and becket 43 while holding the left tensioning bar 30 in place. Alternatively, the user could walk to the opposite side and pull the right tensioning bar 30 to the right.

To move the net 20 to the left, the user again allows slack from the cam and becket 43 and pulls the left tensioning bar 30, resulting in the net 20 gradually moving to the left. The slack in the line 41 allows the line to pass over the pulleys and sheaves in order to reposition the net 20. Once the net is in the proper position, the user can pull out the slack by pulling the line 41 through the cam and becket 43 while holding the left tensioning bar 30 in place.

Figure 7:
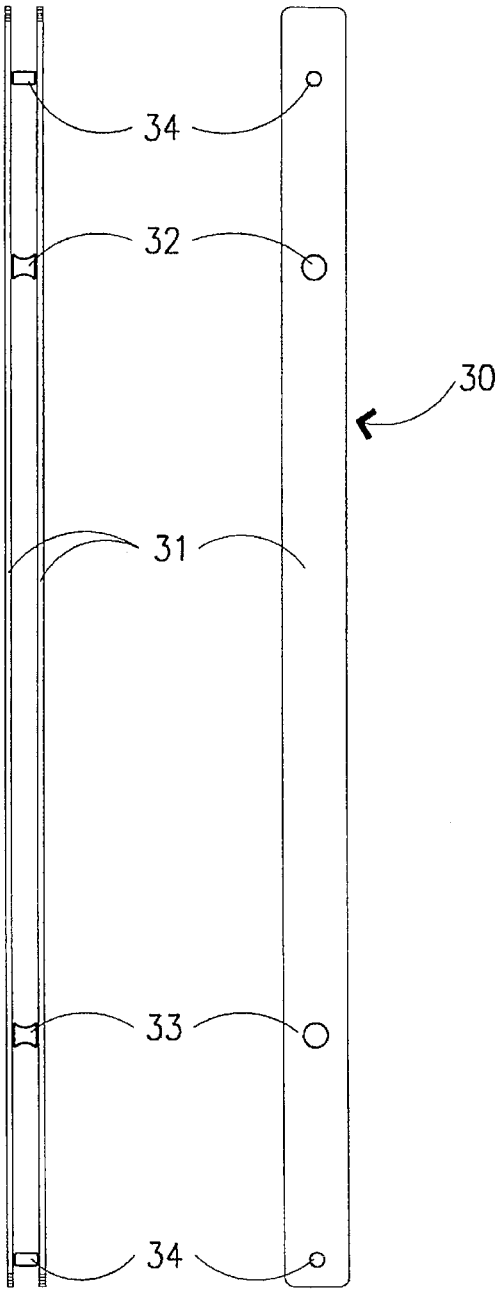
FIG. 7 shows a variation of the preferred tensioning bar shown in FIG. 3.
Figure 6:
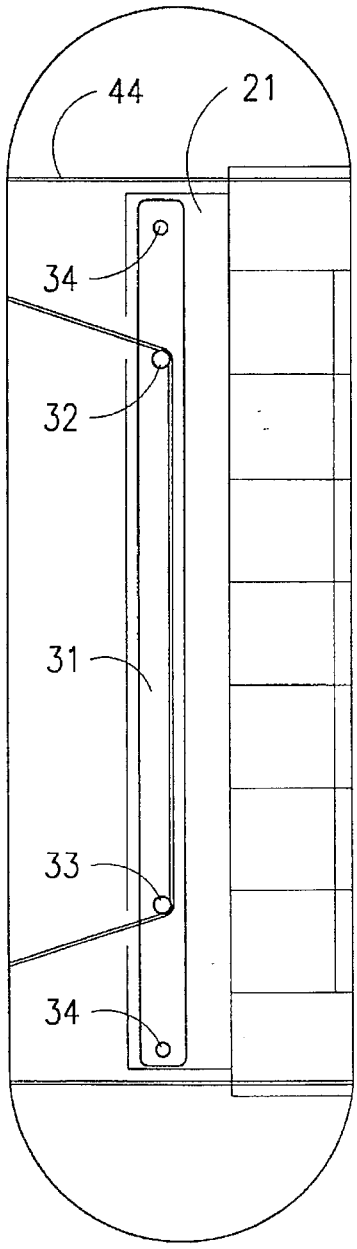
FIG. 6 shows a variation of the preferred side sleeve, tensioning bar, and line shown in FIG. 2.

FIGS. 6 and 7 illustrate a modification of the preferred embodiment, whereby two of the sheaves 32 and 36 are not used, and the line 41 passes above and below the tensioning bars 30 adjacent the top sleeve 22 and bottom sleeve 23.

Figure 8:
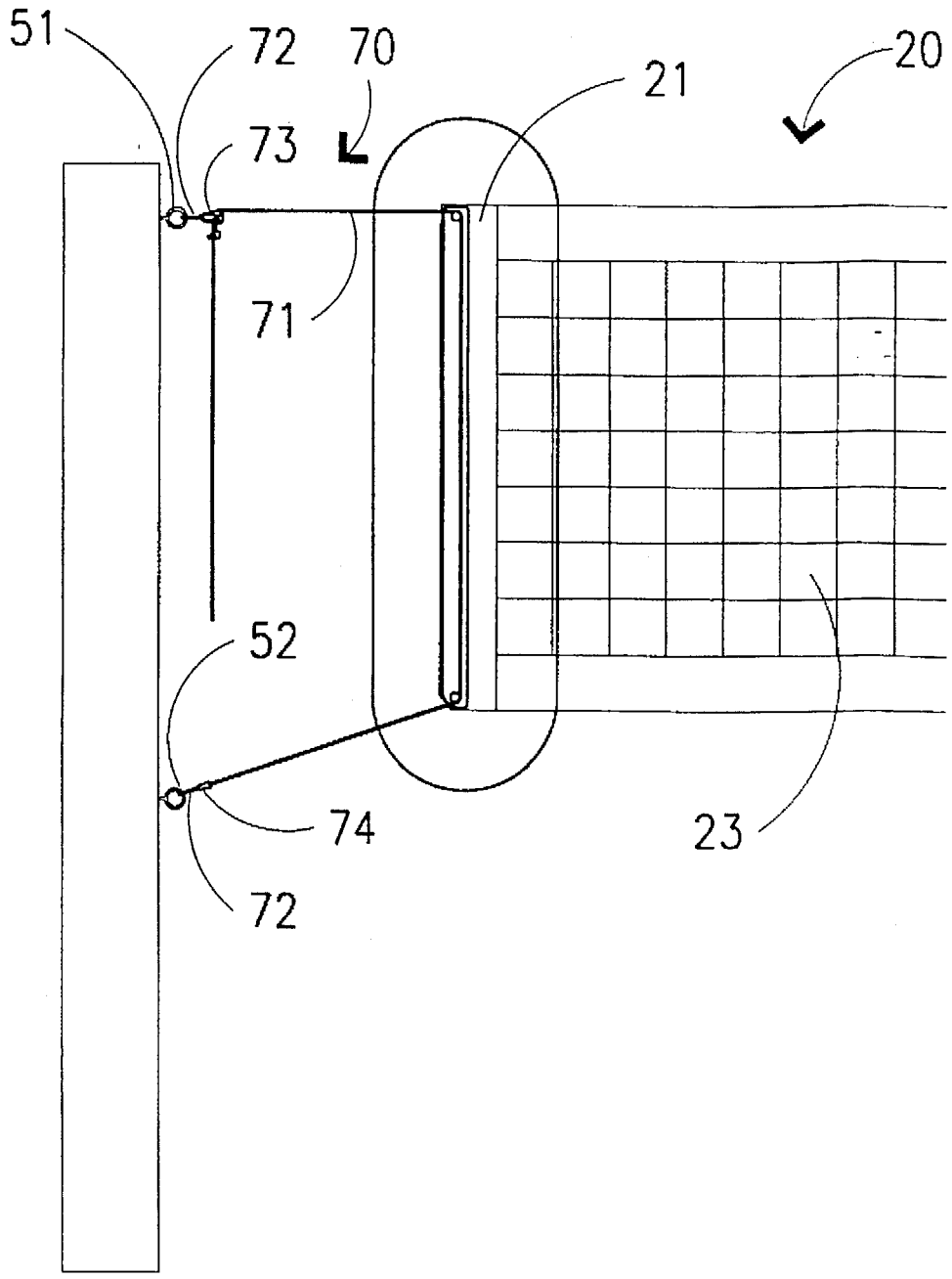
FIG. 8 is a front view of a single end of a second embodiment, showing a post, one end of a net assembly, and a single line assembly and mounting hardware (the second end of this embodiment is substantially similar to the shown end)
Figure 10:
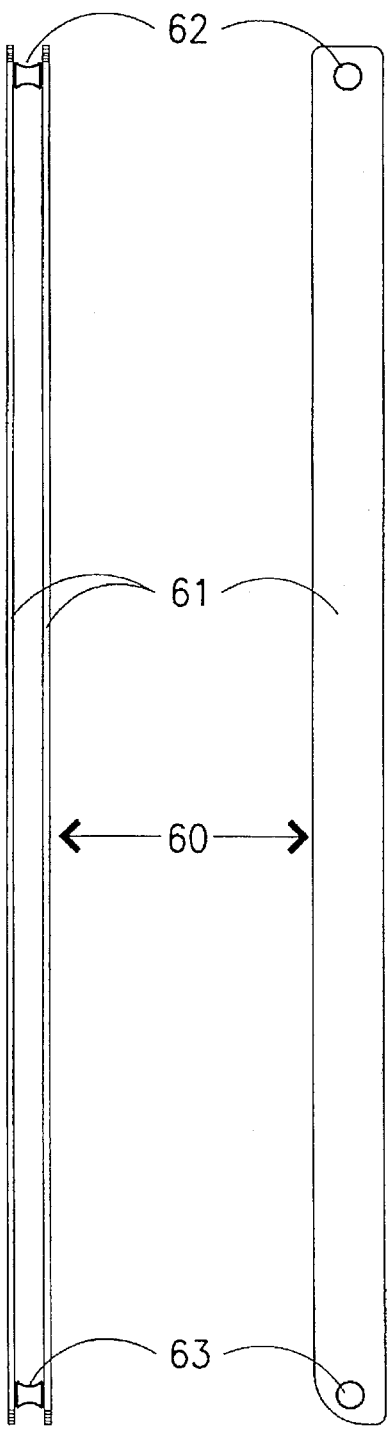
FIG. 10 is an enlarged view of the embodiment shown in FIG. 8, showing front and side views of the tensioning bar.
Figure 9:
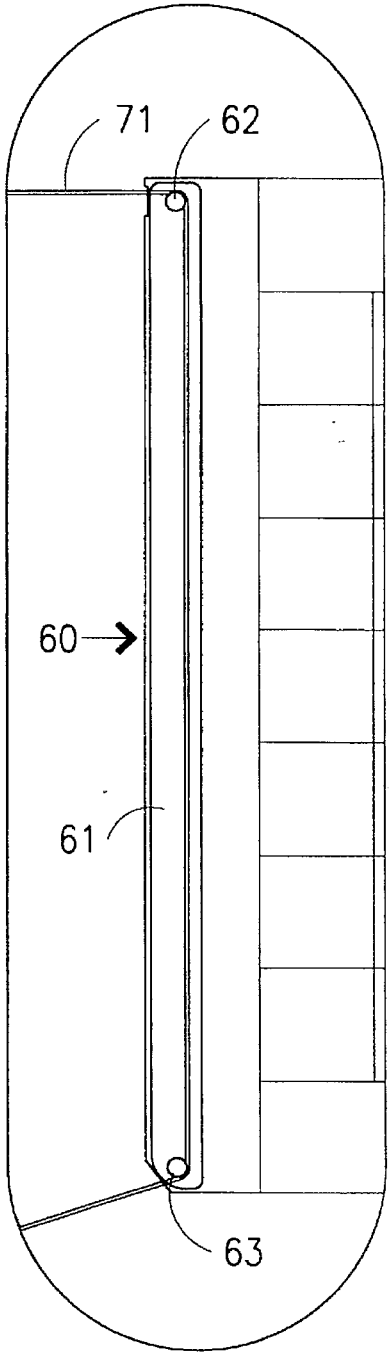
FIG. 9 is an enlarged view of the embodiment shown in FIG. 8, illustrating the interrelationship of a side sleeve, tensioning bar, and line.

A second embodiment is similar to the first and uses a single line on each side of the net to attach and provide tension to the net. The net assembly of the second embodiment preferably has the same basic components as the first preferred embodiment, with changes to the tensioning bars 60 as shown in FIGS. 8, 9 and 10. Each tensioning bar 60 may be horizontally and fixedly attached to a side sleeve 21 of the net 20. Preferably, each tensioning bar 60 is formed with two flat rectangular members 61 that are held parallel to each other and spaced apart by a top sheave 62 and a bottom sheave 63. The left side of FIG. 10 views the tensioning bar 60 from the side nearest to the pole 50. This end is open to allow direct access to the sheaves 62 and 63 for stringing a line. Alternatively, each side sleeve 21 may be formed in the shape of a pocket with each tensioning bar 60 inserted therein, with a pair of slits in each side sleeve 21 to allow a line 71 to be inserted.

Figure 11:
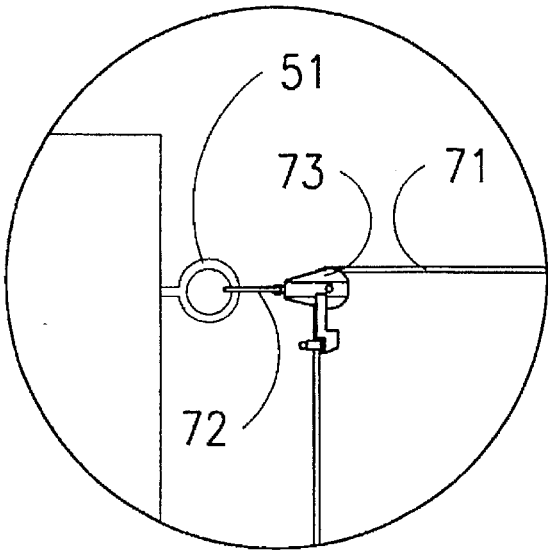
FIG. 11 is an enlarged view of the embodiment shown in FIG. 8, showing a preferred cam and line lock used to secure one end of the line to a top eyebolt.
Figure 12:
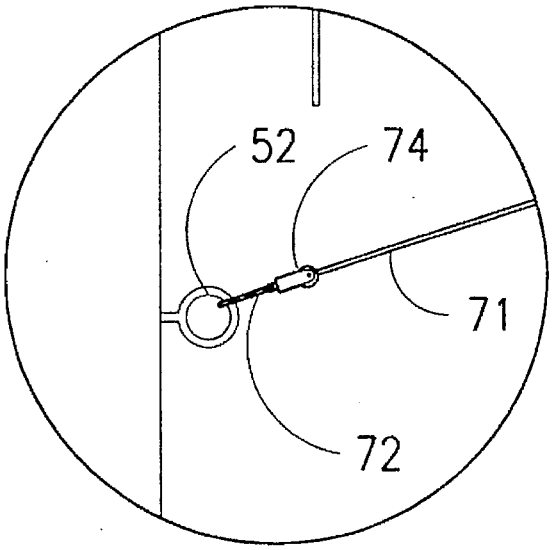
FIG. 12 is an enlarged view of the embodiment shown in FIG. 8, showing the attachment of a preferred becket, coupling and bottom eyebolt.

The second preferred embodiment uses a separate line assembly 70 on each end of the net 20. Each line assembly 70 comprises a single line 71, a pair of couplings 72, a cam and line lock 73, and a becket 74. The second embodiment is different from the first in that the line does not run through the top sleeve 22 and bottom sleeve 23. Each line is originally anchored to the becket 74 (shown in the lower left in FIG. 8 and in detail in FIG. 12). As shown in FIGS. 8 and 9, the preferred line 71 then engages the bottom sheave 63, the top sheave 62 and returns to engage the cam and line lock 73, shown in detail in FIG. 11. The cam and line lock 73 and the becket 74 may be attached to the eyebolts 51 and 52 with detachable couplings 72 or other couplings known in the art. The preferred components are similar to those used for marine applications, as for rigging a sailboat.

As with the first preferred embodiment, all components of the net assembly 20 may remain loosely attached when the net assembly 20 is detached from the eyebolts 51 and 52, thereby preventing loss of components between use. Installing the net can be accomplished in the following few steps, and can easily be accomplished by one person. First, each coupling 42 is attached to a corresponding eyebolt 51 and 52, in the manner shown in FIG. 8. The user then adjusts the slack in the net 20 so as to center the net assembly 20 between the posts 50. This can be accomplished by alternately loosening and tightening each separate line assembly 70 on each end of the net 20.

When the net 20 is centered, the operator may simply pull down on the end of the line 71 extending below the cam and line lock 73. The result is substantially equal force applied on each tensioning bar 60, thereby evenly spreading the tension over the entire netting 23. Tension for the top and bottom of the net is provided by the forces operating on the tensioning bar and translated to the material comprising the top and bottom of the net 20.

To take down the net, the user simply releases the tension using the cam and line lock 73, then detaches each of the couplings 72 from the eyebolts 51 and 52.

Figure 13:
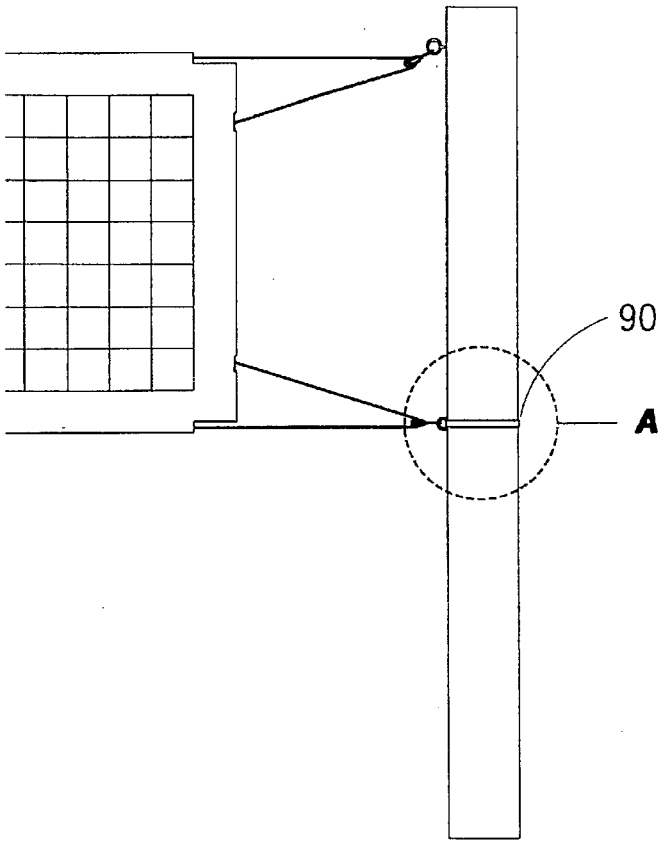
FIG. 13 is a front view of a preferred D-ring strap, shown mounted on a post and supporting a preferred net.
Figure 14:
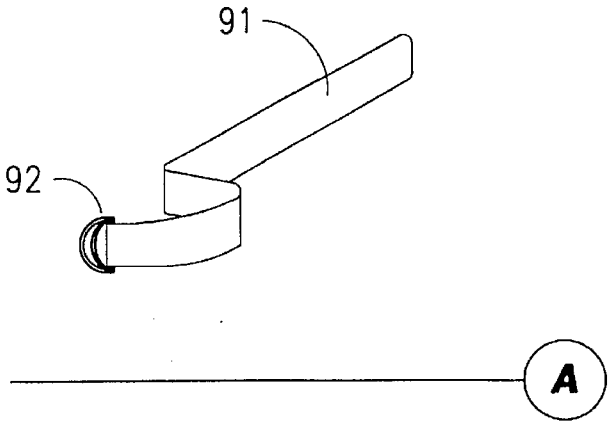
FIG. 14 is a perspective view of the D-ring strap shown in FIG. 13.

An additional problem that this invention addresses is where the top eyebolt 51 or the bottom eyebolt 52 are not at the proper level. Forces supplied by the line assembly 40 acting on each tensioning bar 30 will result in the net assembly being placed at a height generally between the two eyebolts 51 and 52. Therefore, a D-ring strap 90, as shown in FIGS. 13 and 14, may be used. The D-ring strap is constructed of a strap 91 and three rings 92, each generally in the shape of a "D." The strap 91 may be placed around the post 50 and threaded between two of the rings 92, so as to hold the D-ring strap 90 vertically in place. The third ring 92 may then be used to attach a coupling, as shown in FIG. 13. The D-ring strap 90 may be used in place of either or both of the top and bottom eyebolts 51 & 52. The preferred strap 91 is constructed of nylon strapping as is well known in the art, or may alternatively be constructed of other, similar materials. The rings 92 are made of metal or plastic or other similar materials.

Figure 15:
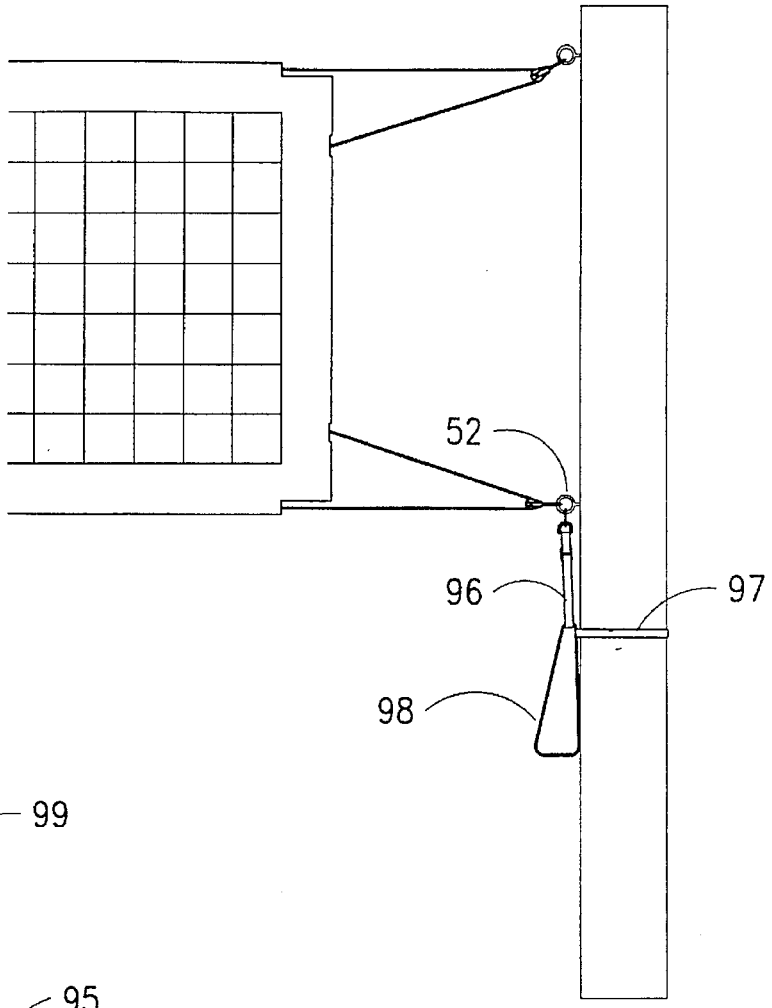
FIG. 15 is a front view of a preferred adjustable stirrup, shown mounted on a post and attached to a bottom eyebolt.
Figure 16:
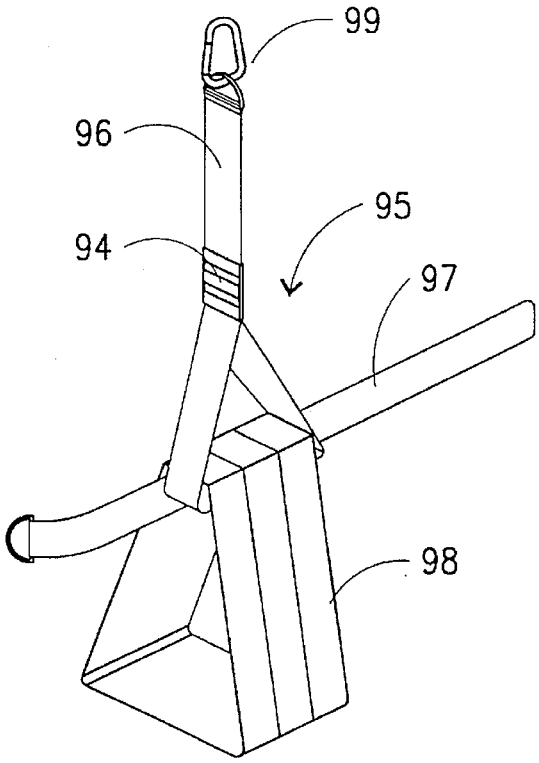
FIG. 16 is a perspective view of the adjustable stirrup shown in FIG. 15.

Lastly, the preferred net attachment and tensioning system includes a device for assisting users in installing and detaching the net assembly 20. FIGS. 15 and 16 show an adjustable strap 95 comprising a stirrup strap 96, safety strap 97, stirrup 98 and connector 99. To use, the adjustable stirrup 95 is attached to the bottom eyebolt 52 by the connector 99. The connector 99 is attached to a ring on an upper end of the stirrup strap 96. Said stirrup strap 96 is looped through the stirrup 98 and then slidably attached to another portion of the strap 96 using an adjustable coupling 94. The stirrup strap 96 is constructed using similar materials to those used with the D-ring strap 90. The stirrup 98 is formed using strapping, as above, plastic, or other similar materials capable of supporting the weight of a person. The stirrup is held near the post 50 by a safety strap 97, which is looped around the post 50 and threaded through two D-rings, much like the D-ring strap described above.

While embodiments of the present invention have been shown and described, various modifications may be made without departing from the scope of the present invention, and all such modifications and equivalents are intended to be covered.

What is claimed is:

1. A volleyball net comprising a net assembly having a right side, a left side, and a netting therebetween, a plurality of rigid tensioning bars attached to said net assembly proximate the right side and the left side of said net assembly, each tensioning bar having a plurality of rotational members attached thereon, a line assembly having a line for threading proximate the rotational members of said tensioning bars, a plurality of couplings attached to the line for attachment to a pair of posts, and a line lock proximate one of said couplings.

2. The volleyball net of claim 1 wherein the rotational members of said tensioning bars are sheaves.

3. The volleyball net of claim 1 wherein each tensioning bar has four sheaves that contact said line during installation and use.

4. The volleyball net of claim 1 wherein each tensioning bar has three sheaves that contact said line during installation and use.

5. The volleyball net of claim 1 wherein each tensioning bar has two sheaves that contact said line during installation and use.

6. The volleyball net of claim 1, wherein said tensioning bars have a plurality of rectangular members, a plurality of rivets therebetween, and a plurality of rotational members.

7. A volleyball net comprising a net assembly having a pair of side sleeves, a top sleeve, a bottom sleeve, and a netting therebetween, a rigid tensioning bar attached to said net assembly proximate each side sleeve of said net assembly, each tensioning bar having a plurality of rectangular members, a plurality of rotational members mounted between the rectangular members, and a plurality of rivets connecting the rectangular members, and a line assembly having a line for threading proximate the rotational members of said tensioning bars, a plurality of couplings threadedly attached to the line for attachment to a pair of posts, and a line lock proximate one of said couplings.

8. The volleyball net of claim 7 wherein said line lock comprises a cam and becket.

9. The volleyball net of claim 7 wherein each tensioning bar is aluminum.

10. The volleyball net of claim 7 wherein each tensioning bar is wood.

11. The volleyball net of claim 7 wherein each tensioning bar is plastic.

12. A volleyball net comprising a net assembly having a pair of side sleeves, a top sleeve, a bottom sleeve, and a netting therebetween, a rigid tensioning bar attached to said net assembly proximate each side sleeve of said net assembly, each tensioning bar having a plurality of rectangular members, a plurality of rotational members mounted between the rectangular members, and a plurality of rivets connecting the rectangular members, a line assembly having a line for threading proximate the rotational members of said tensioning bars, a plurality of couplings threadedly attached to the line for attachment to a pair of posts, and a line lock proximate one of said couplings, at least one D-ring strap attached to each post, and an adjustable stirrup mounted proximate one of the posts for assisting in attachment of said line assembly to the post.

* * * * *